US008567633B2

(12) United States Patent
Askonen

(10) Patent No.: US 8,567,633 B2
(45) Date of Patent: Oct. 29, 2013

(54) WASTE COLLECTION CONTAINER

(75) Inventor: Arto Askonen, Kemi (FI)

(73) Assignee: AWEC-Group Oy (FI)

( * ) Notice: Subject to any disclaimer, the term of this patent is extended or adjusted under 35 U.S.C. 154(b) by 0 days.

(21) Appl. No.: 13/322,465

(22) PCT Filed: May 26, 2010

(86) PCT No.: PCT/FI2010/000035
§ 371 (c)(1),
(2), (4) Date: Nov. 25, 2011

(87) PCT Pub. No.: WO2010/136638
PCT Pub. Date: Dec. 2, 2010

(65) Prior Publication Data

US 2012/0067891 A1 Mar. 22, 2012

(30) Foreign Application Priority Data

May 26, 2009 (FI) ..... 20090210

(51) Int. Cl.
*B65D 25/54* (2006.01)

(52) U.S. Cl.
USPC ..... 220/665

(58) Field of Classification Search
USPC ..... 220/665, 662, 602, 810, 495.06, 908.1, 220/908, 62.14, 660, 62.11; 40/606.12, 40/606.01, 306; 206/459.5, 459.1, 767, 206/769, 770, 771, 772; 312/234
IPC ..... B65D 25/54
See application file for complete search history.

(56) References Cited

U.S. PATENT DOCUMENTS

| | | | | |
|---|---|---|---|---|
| 5,255,968 | A * | 10/1993 | Craven | 312/234 |
| 5,772,063 | A * | 6/1998 | Gantz-Bloome | 220/500 |
| 2003/0038132 | A1 * | 2/2003 | Zilberman | 220/62.14 |
| 2006/0086025 | A1 | 4/2006 | Benedict | |

FOREIGN PATENT DOCUMENTS

DE 202004014301 12/2004

* cited by examiner

*Primary Examiner* — Robert J Hicks
(74) *Attorney, Agent, or Firm* — Galbreath Law Offices, P.C.; John A. Galbreath

(57) ABSTRACT

Waste container that is formed of a base part with a container body attached, the body comprising an outer casing and a cover plate with a gap for putting in waste attached to the container body's upper surface. The body comprises at least one curved surface that makes the body take the shape of a vertical cylinder whose surface is meant to be a media surface for commercials. The transparent casing is located outside the surface, and the film that functions as the media surface is located between the curved surface and the casing. A transparent, curved casing can be made to be more curved for changing the media surface, where out of the length of both side edges of the casing at least a part comes out of the slot places formed at the edges of the curved surface, so that the casing can diverge from the curved surface.

8 Claims, 2 Drawing Sheets

WASTE COLLECTION CONTAINER

Invention relates to a waste collection container that is formed of a base part, a base plate attached on top of it and a part of a container body that functions as an outer casing and a cover plate attached to the upper surface of the container body in which case the cover plate comprises a gap for locating waste into the container and the container body comprises at least one curved surface that makes the mentioned body to have a shape of a vertical cylinder which surface is meant to be a media surface for example for commercials and that a transparent casing is located outside the mentioned surface in which case the film functioning as the media surface is located between the curved surface and the casing.

Previously a waste container is known for example from the published application FI-20040061 in which published application the outer surface of the refuse sack belonging to the waste container can be arranged to be a media surface when the refuse sack is outside the container being a slightly stretched and flat outermost part of the container. When the refuse sack is being changed, a new sack can be fitted again to replace the old one the outer surface of which can again function as a media surface. The disadvantage of this kind of solution is the difficult changing of the refuse sack because not until during the changing situation the waste actually becomes moved into the refuse sack. The refuse sack must be removed through the lower part around the container body in which case there must be room for it underneath the container body. The waste container must be a model that can be hung. The container body cannot be installed on a base.

The disadvantage of the above mentioned solution is the shape of the media surface that deviates from the ordinary shape. When the outer surface of the sack functions as the media surface, it is a more difficult solution regarding the print technique and they must be ordered as special products. The media surface also changes whenever the refuse sack becomes changed. When the refuse sack functions as the outermost part, it also becomes damaged easily.

In order to remove these disadvantages a new waste container has been developed with which a considerable improvement regarding the fitting and usability of the media surface can be achieved. It is characteristic of the waste container according to the invention that a transparent, curved casing can be brought to a steeper curvature for the changing of the media surface in which case at least a part of the length of the both side edges of the casing comes out of the slot places formed at the edges of the curved surface in order to detach the casing from the curved surface.

The advantage of the container according to the invention is the fact that the changing of the media surface does not depend on the emptying of the refuse sack belonging to the container. The changing can naturally be performed also when the sack is being changed. A conventional paper poster can be used as a media surface which paper poster stays in its place without becoming damaged. The changing of the media surface is a very fast procedure during which it simply becomes dropped into its place with the help of guide surfaces. The refuse sack is protected all the time and there is no chance that it would become damaged.

In the following the invention is explained more detailed by referring to the accompanying drawing in which FIG. 1 shows a collection container as a front view.

Figure 1:
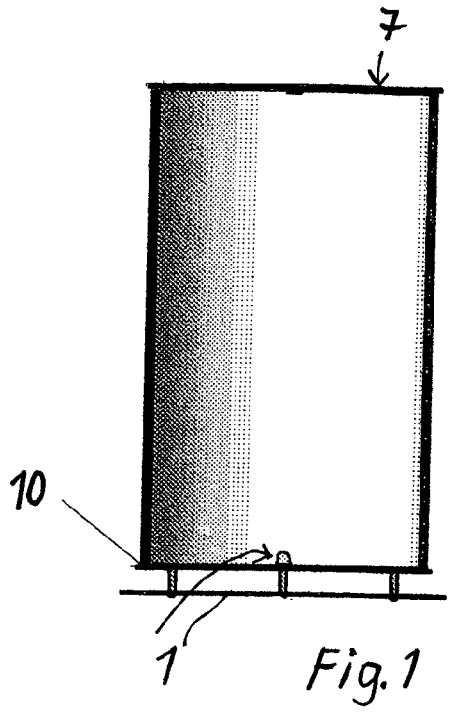
Figure 2:
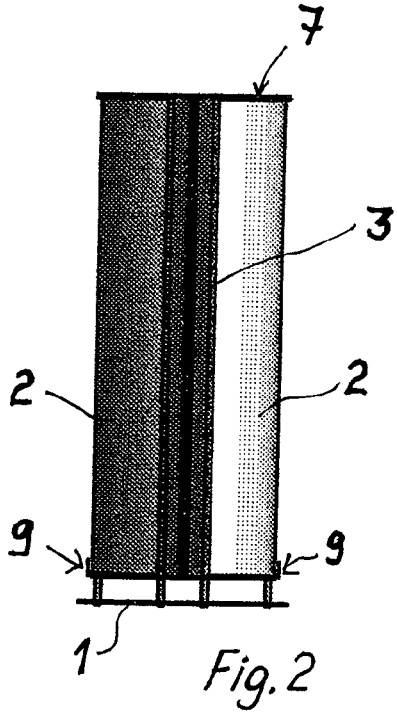
FIG. 2 shows the container of the FIG. 1 as a side view.
Figure 3:
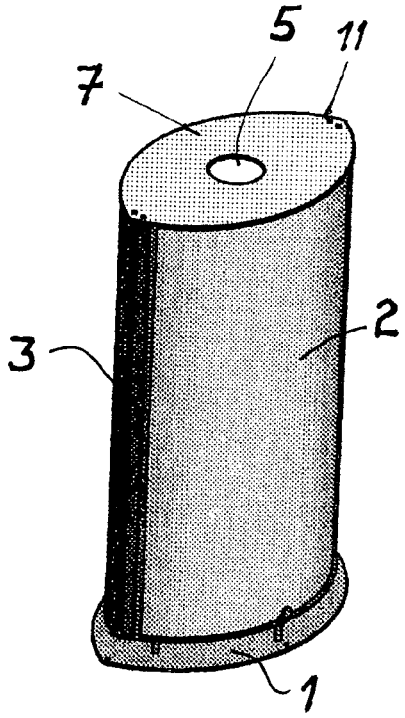
FIG. 3 shows the container of the FIG. 1 diagonally seen from above.

In the FIGS. 1-3 a waste container according to the invention is shown which waste container comprises a base 1, a base plate 10 located on the top of it, curved sides the outermost part of which sides is a transparent casing 2, vertical side battens 3 at the opposite sides of the container and a cover plate 7 that has a gap 5 for locating the waste.

Figure 4:
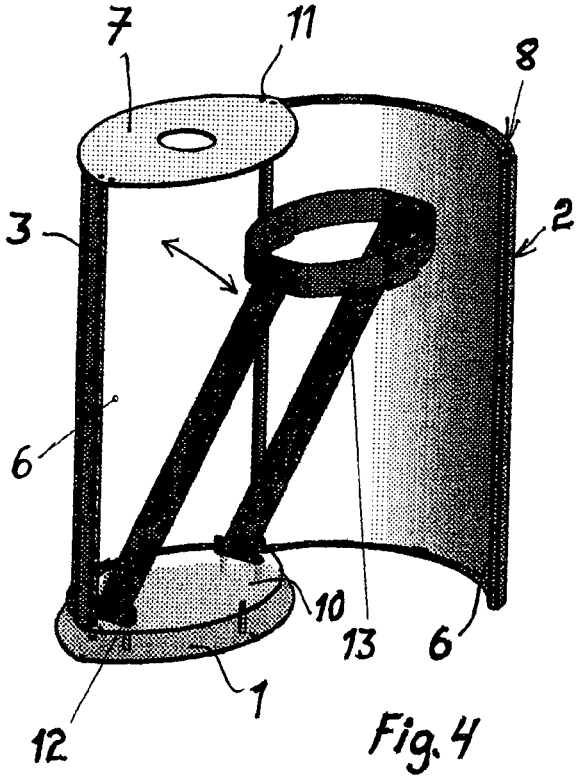
FIG. 4 shows the container of the FIG. 1 when the curved surface of the front part is being opened.

In the FIG. 4 the opening of a hinged front part which is a curved surface 6 from the point 11 to the container body is shown in such a way that a refuse sack that has been hung to a rack 12, 13 can be removed and fitted to its place. The rack can be tilted slightly outwards in order to ease the changing of the sack. There is a curved surface 6 at the opened front part which surface functions as a stiffener of the part to be opened and as a back plate for the media surface, such as for a poster 8 that is located between a transparent casing 2 and the curved surface 6. In practice the opening of the curved surface 6 is made possible only with a key.

Figure 5:
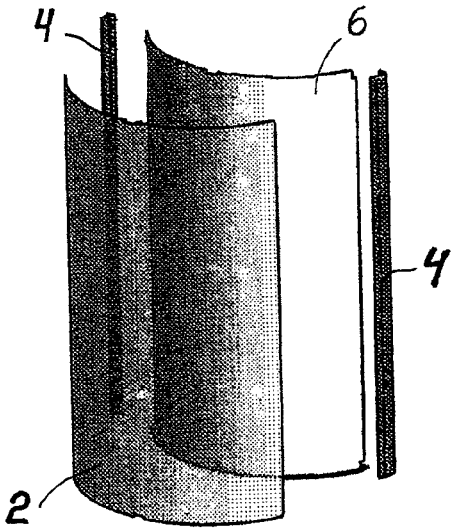
FIG. 5 shows the parts of the front part of the container of the FIG. 1 as separate parts.

In the FIG. 5 components of the front part of the container are shown as separate parts. The outermost part is a transparent casing 2. There is a curved, most advantageously metallic surface 6 behind it which surface is formed to be curved and keeps its form. There are battens 4 at the both sides of the curved surface 6 which battens are attached to the side battens 3 of the container. A flexible, transparent casing 2 is bent to be curved and it is let to become strung up against the curved surface 6 in such a way that its edges fit into the slot grooves of the battens 4. Thus the transparent casing 2 becomes attached against the curved surface 6. The transparent casing 2 is most advantageously made of plastic, such as a polycarbonate plate or an acryl plate. The transparent casing 2 is adjusted to be a little bit wider than the poster 8 to be fitted so that the poster is easily directed between the battens 4.

Figure 6:
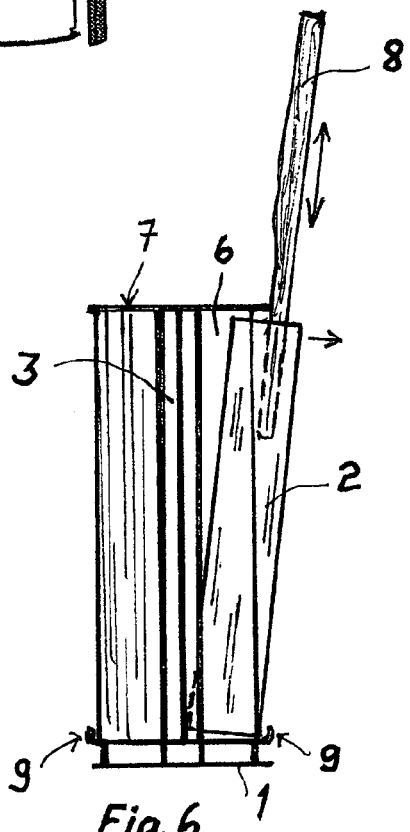
FIG. 6 shows the container according to the invention as a side view when the casing of the media surface is being pulled slightly outwards from the upper edge.

In the FIG. 6 the locating/removing of a media surface, such as a poster 8 from the space between the transparent casing 2 and the curved surface 6 is shown. It has been pulled outwards from the upper edge of the transparent casing 2 in such a way that the strained transparent casing 2 starts to curve more and comes out starting from the upper edge from the slot places being by the side battens 3. The transparent casing 2 is pulled out usually only so much so that one can grip the poster 8 and pull it up away from between the transparent casing 2 and the curved surface 6. A new poster 8 is fitted analogously by dropping it into the mentioned space. The lower end of the transparent casing 2 stays to be strung up in the slot places of the battens 4. The upper edge of the transparent casing 2 is very easy to push back to its place when it at the same time becomes a little bit squeezed to be more curved at its edges. At the usage position the upper edge of the transparent casing 2 is located underneath the cover plate 7 inside its outer circle being protected in which case the rain water cannot reach the poster 8.

Figure 7:
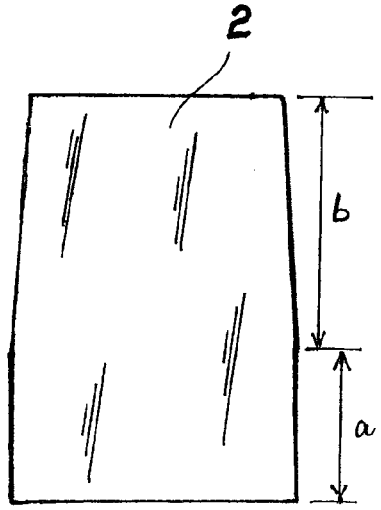
FIG. 7 shows the transparent casing of the media surface.

In the FIG. 7 one advantageous embodiment of the casing is shown in which embodiment the width of the casing increases slightly downwards. The transparent casing 2 is a straight plate being free. At the part a of the lower part the width is standard but at the part b the width becomes narrower upwards. With this construction the transparent casing 2 is easier to pull outwards starting from the upper edge away from the suspense of the slot places. Gradually the transparent casing 2 starts to resist more the extraction in which case it is left for example at the position of the FIG. 6 for the changing of the poster 8. Arresting devices 9 belong to the base plate 10 which arresting devices prevent the lower edge of the transparent casing 2 from becoming loose and moving outwards at the stage where the transparent casing 2 is being pulled outwards from the upper part. Alternatively the transparent casing 2 can also have a standard width or be like in the FIG. 7, but in addition to that the slot battens 4 can be wider on the way down so that they prevent the lower part of the transparent casing 2 from coming out the more, the more the casing is being pulled outwards from the upper part.

Figure 8:
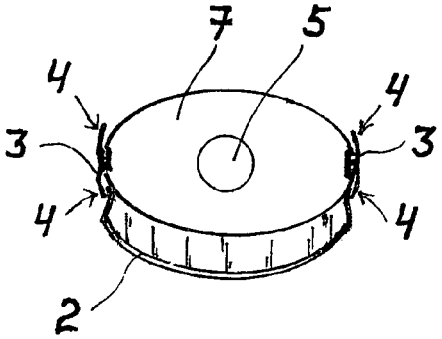
FIG. 8 shows the container of the FIG. 6 seen from above.

In the FIG. 8 the situation of the FIG. 6 is shown seen from above and the slot places formed with the battens 4 from which a part of the edges of the casing has been removed.

Curved surfaces 6 and thus room for posters can be even more around the container, such as 3 pieces instead of the two curved surfaces (in the front and at the back) shown in the figure.

The invention claimed is:

1. Waste collection container that is formed of a base part (1), a container body attached on top of it, said container body comprising:

an outer casing and a cover plate (7) attached to the upper surface of the container body wherein the cover plate comprises a gap (5) for locating waste into said container, and at least one curved surface (6) having slot places formed at its edges and said surface makes the mentioned body to have a shape of a vertical cylinder and which surface is meant to be a media surface, as a film for commercials (8) and a transparent casing (2), having side edges is located outside the curved surface (6) wherein the media surface is located between the curved surface (6) and the transparent casing (2), characterized in that the transparent, curved casing (2) can be brought to be even more curved for the changing of the media surface wherein out of the length of the both side edges of the transparent casing (2) at least a part comes out of the slot places formed at the edges of the curved surface (6) so that the transparent casing (2) can diverge from the curved surface (6).

2. Container according to the claim 1, characterized in that the transparent casing (2) can be pulled outwards from its upper edge to be even more curved and away from the curved surface (6).

3. Container according to the claim 1, characterized in that the transparent casing (2) is wider at its lower part in order to increase a needed pulling force the more it becomes pulled outwards from its upper part.

4. Container according to the claim 1, characterized in that the depth of the slot places increases on the way down the length of the slot places, to increase a needed pulling force the more it becomes pulled from its upper edge.

5. Container according to the claim 1, characterized in that there are several curved surfaces (6) around the container body.

6. Container according to the claim 1, characterized in that the transparent casing (2) is a straight plate that can be bent to be curved.

7. Container according to the claim 1, characterized in that the upper edge of the casing (2) is located in the usage position inside the cover plate (7).

8. Container according to the claim 1, characterized in that the width of the transparent casing (2) is arranged to be larger than the width of the media surface.

* * * * *